US010865036B2

(12) United States Patent
Golding

(10) Patent No.: US 10,865,036 B2
(45) Date of Patent: Dec. 15, 2020

(54) BEVERAGE CAN HAVING A GROMMET

(71) Applicant: CROWN Packaging Technology, Inc., Alsip, IL (US)

(72) Inventor: Richard Mark Orlando Golding, Mount Prospect, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 70 days.

(21) Appl. No.: 16/224,928

(22) Filed: Dec. 19, 2018

(65) Prior Publication Data

US 2019/0119033 A1 Apr. 25, 2019

Related U.S. Application Data

(62) Division of application No. 15/135,181, filed on Apr. 21, 2016, now Pat. No. 10,246,250.

(51) Int. Cl.

| | |
|---|---|
| ***B65D 83/42*** | (2006.01) |
| ***B21D 51/38*** | (2006.01) |
| ***B65D 83/38*** | (2006.01) |
| ***B65D 1/20*** | (2006.01) |
| ***B65D 1/16*** | (2006.01) |
| *B21D 28/28* | (2006.01) |

(52) U.S. Cl.

CPC ..... *B65D 83/425* (2013.01); *B21D 51/38* (2013.01); *B21D 51/383* (2013.01); *B65D 1/165* (2013.01); *B65D 1/20* (2013.01); *B65D 83/38* (2013.01); *B65D 83/42* (2013.01); *B21D 28/28* (2013.01)

(58) Field of Classification Search

CPC ..... B65D 83/425; B65D 83/38; B65D 1/20; B65D 1/165; B65D 83/42; B21D 51/383; B21D 51/38; B21D 28/28

See application file for complete search history.

(56) References Cited

U.S. PATENT DOCUMENTS

| | | | | |
|---|---|---|---|---|
| 3,880,187 | A * | 4/1975 | Kneusel | B65D 83/70 137/843 |
| 5,232,124 | A | 8/1993 | Schneider et al. | |
| 6,729,362 | B2 | 5/2004 | Scheindel | |
| 8,517,217 | B2 * | 8/2013 | Kraus | B65D 83/70 169/9 |
| 2014/0353318 | A1 | 12/2014 | Fields | |
| 2016/0031594 | A1 | 2/2016 | Ramsey | |

FOREIGN PATENT DOCUMENTS

| | | |
|---|---|---|
| WO | WO 00/47492 A1 | 8/2000 |

* cited by examiner

*Primary Examiner* — John C Hong
(74) *Attorney, Agent, or Firm* — BakerHostetler

(57) ABSTRACT

A drawn and wall ironed beverage can body, method for forming same, and a sealed and filled can, include a through-hole or aperture in the base. A grommet for charging a propellant in can is located in the aperture. The aperture has a burr that is located on the inboard side of the rim of the aperture. A method of forming a valve in the drawn and ironed beverage can body includes positioning a first tool in an interior of the can body, contacting an exterior surface of the base with a second tool such that the first and second tools are aligned, forming the aperture in the base, and inserting the grommet into the aperture.

14 Claims, 4 Drawing Sheets

BEVERAGE CAN HAVING A GROMMET

CROSS-REFERENCE TO RELATED APPLICATIONS

This application is a divisional application of U.S. patent application Ser. No. 15/135,181, filed Apr. 21, 2016, the disclosure of which is incorporated herein by reference in its entirety.

TECHNICAL FIELD

The present invention relates to containers, and more particularly to pressurized beverage containers having a valve.

BACKGROUND

Commercial beverage cans are typically formed of two pieces: a drawn and wall-ironed ("DWI") body and an end or lid seamed onto the open end of the can body. In the DWI process for forming a can body, a circular blank is first cut from a sheet of a 3000 series aluminum alloy, such as 3004 having the following properties according to (ASTM B209-14):

Aluminium: 95.6 to 98.2% (or remainder after the limits below)
Copper: 0.25% max
Iron: 0.7% max
Magnesium: 0.8 to 1.3%
Manganese: 1.0 to 1.5%
Silicon: 0.3% max
Zinc: 0.25% max
Residuals: 0.15% max The blank is drawn into a cup in a machine referred to as a cupper. The drawing process typically does not change the thickness of the material, such that the sidewall and base of the cup have the same or nearly the same thickness as the blank.

The cup is then transferred into a machine referred to as a bodymaker, in which a cylindrical ram is inserted into the open end of the cup in a close fit. The ram them pushes the cup through a series of circular dies. Each die has an opening diameter that is slightly less than the outside diameter of the metal of the cup. Thus the metal is "ironed" in each die, which thins and elongates the sidewall. At or near the end of the ironing stages, the ram pushes the can body onto doming tooling, which deforms the flat can bottom into a dome and forms the foot. The most popular size of commercial beverage cans have a dome having a thickness of approximately 0.010 inches thick. In most circumstances, the bottom of the can is structurally complete at the end of the bodymaking operation.

After the bodymaker, the can body typically goes through operations that form a neck and a flange on the open end of the can. The can body before filling with the product is coated with a conventional lacquer to provide a barrier between the liquid product and the aluminum.

The end or lid is typically formed of a 5000 series aluminum alloy in a shell press that forms a circular blank into a shell and a conversion press that attaches the tab to the shell. After filling, an end is positioned on the can body such that the peripheral curl structure of the end is aligned with the can body flange. The both the end and the can body are mutually deformed to form the seam.

The internal pressure in a beverage can typically is from gas entrained in the liquid product, or generated from liquid nitrogen dosing prior to seaming the container.

It has been a longstanding focus of DWI beverage can manufacturers to make the can lightweight and structurally intact, even when the can is under pressure and is given rough handling.

Aerosol cans typically are made of three pieces: a domed end that is fitted with a dispensing valve, a cylindrical body that is open on each end, and a shallow bottom end. The can body is typically formed by rolling a flat sheet of tinplate steel and welding the ends together to form a longitudinal joint. The bottom end and domed ends are seamed onto the open ends of the welded cylinder.

Aerosol cans typically have a valve in the top component of the can, which is used for charging the can with propellant. Alternatively a grommet that is located in an aperture in the domed base, may be used for charging the can with a propellant, which typically is a volatile hydrocarbon. The grommet in the domed base is used when the product and the propellant must remain separate. For example, popular commercial systems, referred to bag-in-can or bag-on-valve, use a pouch or bag that holds the product while the propellant surrounds the bag. Some applications use a piston barrier to separate the product from the propellant, such as technology marketed under the tradename Earthsafe™ by a sister company of the present assignee.

Several conventional grommets are commercially available for charging aerosol cans with propellant, as will be understood by persons familiar with technology of charging aerosol cans. In a conventional aerosol can, an aperture is formed in the bottom end before the end is seamed onto the cylindrical can body. Because the aperture is formed in the unattached end, opposing tools have easy access to contact the upper and lower surfaces of the end. The grommet can then be installed into the aperture from either the topside or underside of the end before seaming onto the can body.

SUMMARY

In the process of forming an aperture, also referred to as a through-hole, by a tool opposing tools puncturing a metal sheet, a burr typically is formed.

A burr formed on the inboard side of the rim of the aperture may reduce contact between the burr and the liquid product (compared with a burr located on the outboard side of the aperture rim), as the burr may be in contact with or buried in the elastomer or polymer of the grommet. The burr may be uncoated or have less coating than the topside of the domed base, and therefore contact between the burr and the liquid product has the possibility of having a detrimental effect on the product.

According to an aspect of the invention, a filled and sealed beverage can, an unseamed can body, and a method for forming a valve/grommet in a can body are provided. The filled and sealed beverage can includes the drawn and wall ironed can body that includes a dome in the base, a foot outboard the base, and an elongate ironed sidewall extending upwardly from the foot. The dome has an aperture formed through the dome and a wall about the aperture that terminates in a rim. A burr is located on an inboard portion of the rim. A grommet is disposed in the aperture. An inboard portion of the aperture is in contact with the liquid product contents of the can. The beverage can also includes an end seamed to an open end of the can body opposite the base to enclose the can.

In a preferred embodiment, the wall is an upstanding wall that is vertical or nearly vertical and is circumferential about the aperture. The dome may be recess-less about the upstanding wall such that the base of the grommet is not recessed relative to the dome, or may dome may have a recess (such as about the aperture and/or wall) such that the base of the grommet is recessed relative to the dome.

Preferably, the upstanding wall terminates at a rim surface that forms an angle A relative to a horizontal reference line that is between −30 degrees and 60 degrees, preferably between zero and 45 degrees, and more preferably between 5 and 40 degrees.

As the burr is on the inboard side, the burr may contact the grommet. The grommet includes a base located on the outboard side of the dome, a crown located on the inboard side of the dome, and a neck between the base and the dome for receiving the rim of the aperture. Thus, in a preferred embodiment the burr contacts the neck of the grommet when the grommet is in its sealing state. Because the dome of the grommet is in the interior of the can, a portion of the grommet contacts the liquid product.

The method of forming a valve in a drawn and ironed beverage can body begins with a one-piece, drawn and ironed beverage can body that includes a dome in the base, a foot outboard of the base, and an elongate ironed sidewall extending upwardly from the foot. The method includes the steps of positioning a first tool in an interior of the can body; contacting an exterior surface of the dome with a second tool such that the first and second tools are aligned; forming an aperture in the dome by the action of the first and second tools such that a burr is formed on a inboard rim of the aperture; and inserting a grommet into the aperture. The first tool contacts an interior surface of the dome. And the burr is inwardly oriented relative to the grommet.

The forming step preferably includes (or the method includes another step of) deforming a portion of the dome adjacent the aperture to form an upstanding wall. Preferably the deforming step occurs at the same time as the forming step and before the inserting step. Preferably, the upstanding wall is vertical or nearly vertical and is circumferential about the aperture.

The dome may be recess-less about the upstanding wall such that the base of the grommet is not recessed relative to the dome, or the dome may has a recess, as the result of any of the method steps, about the upstanding wall such that the base of the grommet is recessed relative to the dome.

Preferably, the upstanding wall is formed such that the upstanding wall terminates at a rim surface that forms an angle A relative to a horizontal reference line that is between −30 degrees and 60 degrees, preferably between zero and 45 degrees, and more preferably between 5 and 40 degrees.

As the burr is on the inboard side, the burr may contact the grommet when assembled. The grommet includes a base located on the outboard side of the dome, a crown located on the inboard side of the dome, and a neck between the base and the dome for receiving the rim of the aperture. Thus, in a preferred embodiment the burr contacts the neck of the grommet when the grommet is in its sealing state. Because the dome of the grommet is in the interior of the can, a portion of the grommet contacts the liquid product.

DETAILED DESCRIPTION OF ILLUSTRATIVE EMBODIMENTS

Figure 2:
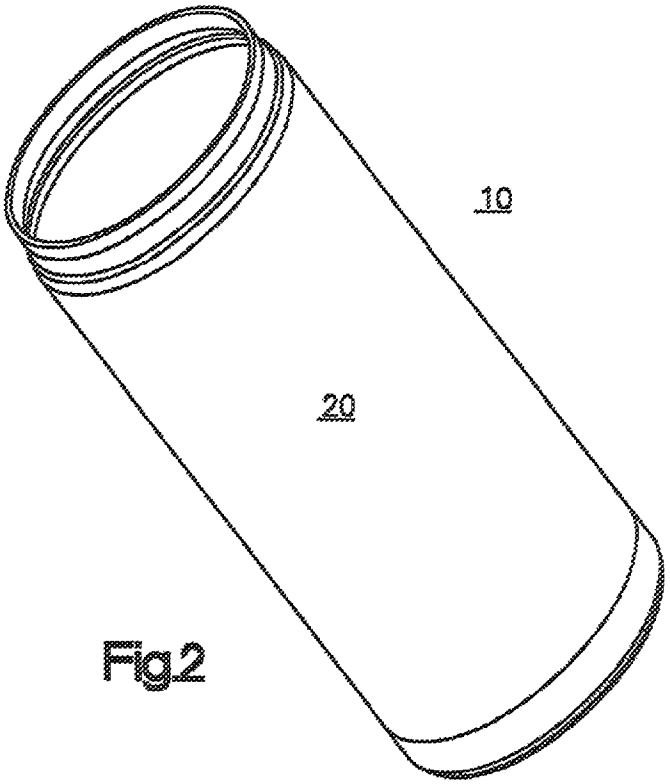
FIG. 2 is a top perspective view of the beverage can assembly of FIG. 1, with the end removed for clarity.
Figure 1:
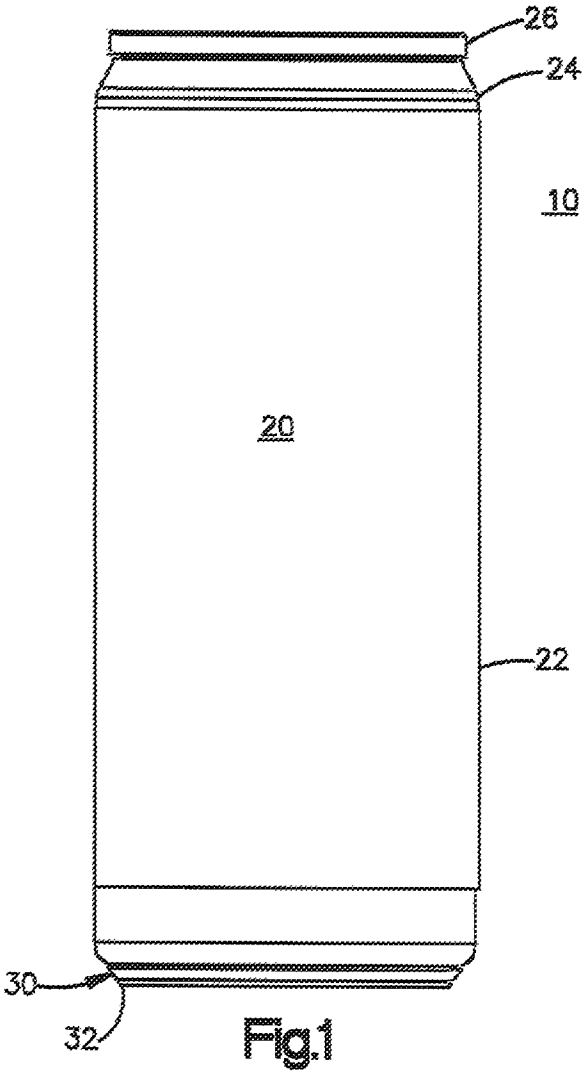
FIG. 1 is a side view of a beverage can assembly according to an aspect of the present invention.
Figure 4:
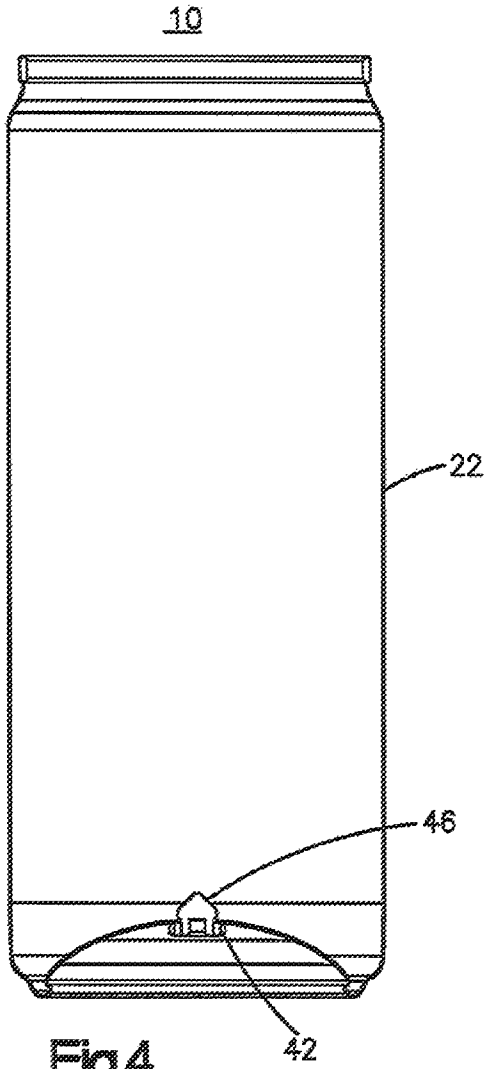
FIG. 4 is a longitudinal cross section view bisecting the can assembly of FIG. 1.
Figure 3:
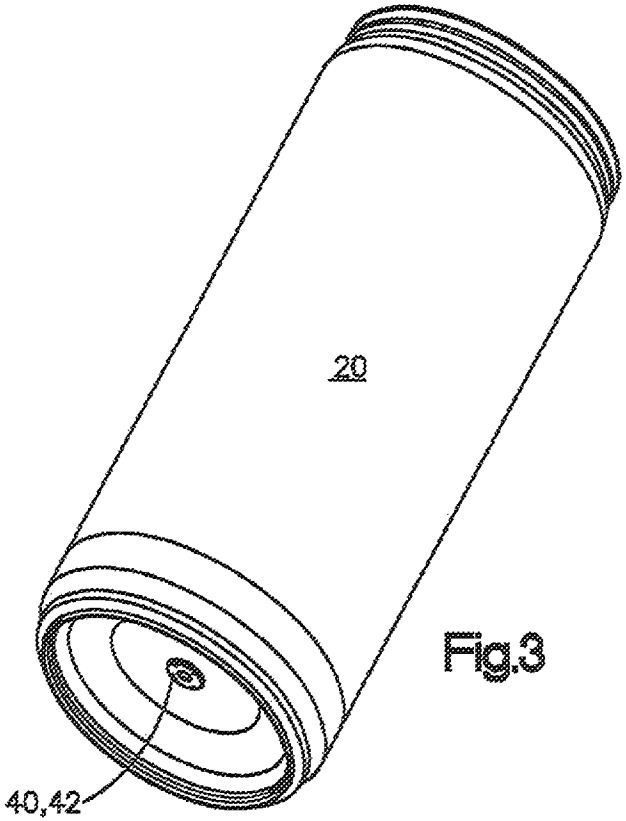
FIG. 3 is a bottom perspective view of the beverage can assembly of FIG. 1.
Figure 6:
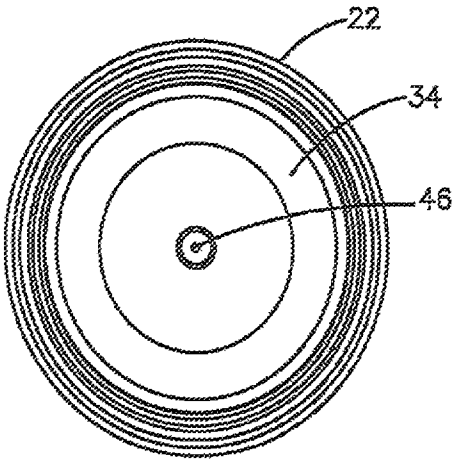
FIG. 6 is a top view of the can of FIG. 1, with the end of the can assembly removed for clarity.
Figure 7:
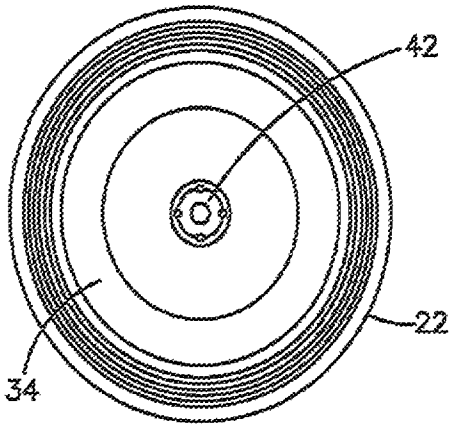
FIG. 7 is bottom view of the can assembly of FIG. 1.
Figure 5:
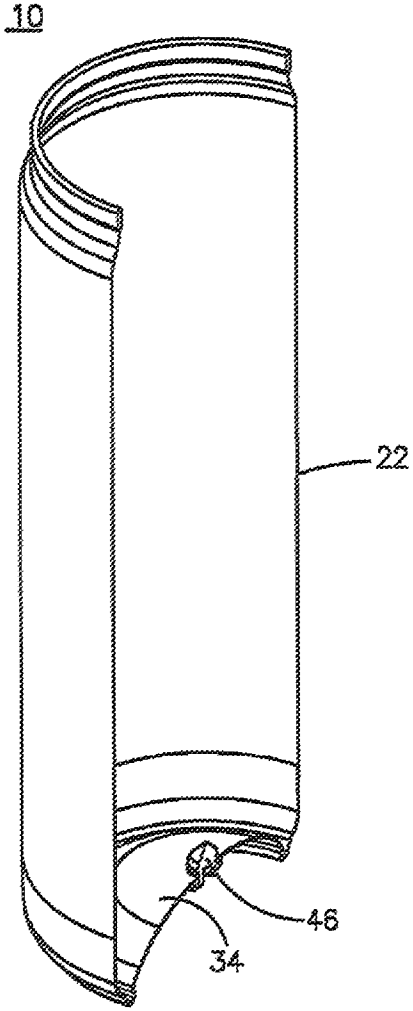
FIG. 5 is a perspective view of the cross section of FIG. 4.

Referring to the figures, a beverage can assembly 10 includes a can body 20, an end, and a grommet 40. In the figures, the can end is omitted for clarity to illustrate the grommet.

The can end, which may be conventional, is seamed onto the end of the can body. It is understood that the can end may be, for example, one of the ends as marketed by Crown Cork & Seal, Inc. under its SuperEnd mark, such as an end as generally described in U.S. patent application Ser. No. 14/291,298, filed May 30, 2014 and entitled "Beverage Can End Having an Arcuate Panel Wall and Curved Transition Wall," the structural description of which is incorporated herein by reference. Accordingly, it is understood that the end includes a curl or hook that cooperates with a can body flange to form the seam shown in the figures, a center panel, a pour opening defined by a score on the center panel, a tab for opening the pour opening upon actuation, and other structure that will be understood by persons familiar with beverage can configuration. The present invention is not limited to the particular end configuration.

It is understood that the present invention is employed with a sidewall that is formed by wall ironing and bottom that is formed in by a doming operation. Thus, it is understood that the present invention encompasses any upper configuration of the can, such as DWI metal bottles having necks that taper to a neck finish and that often are capped with a roll-on pilfer-proof metal closures, and metal cans having small, seamed on ends such as disclosed in U.S. patent application Ser. No. 14/773,892, filed Sep. 9, 2015 and entitled "Necked Beverage Can Having a Seamed-On End," sometimes referred to as Cottle™ cans.

Can body 20 is a drawn and wall-ironed, single-piece body that includes an integral sidewall 22, a neck 24 that extends to a seam 26, and a base 30. Base 30 extends from the lower portion of sidewall 22 and includes a foot 32, inboard of which is a dome 34. In cross section, foot 32 includes the curved standing ring on which the can rests, an inboard wall of the foot that extends upwardly from the standing ring, and a transition that merges into the dome 34. The profile shape of base 30 may be conventional.

Preferably, can body 20 is a conventional 211 or 66 mm can body of the type that is sold commercially in the United States as a 12 ounce or 16 ounce can and in Europe as a 330 ml or 440 ml can. The can body can be any height and diameter, such as 52 mm or 58 mm diameter marketed as Slim™ or Sleek™ cans, or any other DWI beverage can body diameter. The can body is formed of a 3000 series aluminum, such as 3004. Sidewall 22 typically is approximately 0.004 inches thick, or 0.003 inches to 0.006 inches. Dome 34 is typically approximately 0.010 inches thick, or 0.008 inches to 0.011 inches.

An aperture 36 is formed in the base, preferably at the center for convenience of forming and charging. Aperture 36 preferably includes a wall 62 that deviates, in cross sectional profile, from the curvature of dome 34. To the extent that wall 62 deviates from the curvature of the dome local to wall 62, wall 62 is referred to as an upstanding wall. Preferably, the wall projects inwardly (that it, inward toward the can or upwardly in the resting orientation). Alternatively, the present invention may be employed with a dome for which there is no wall at all, either inwardly protruding or outwardly protruding.

Figure 10:
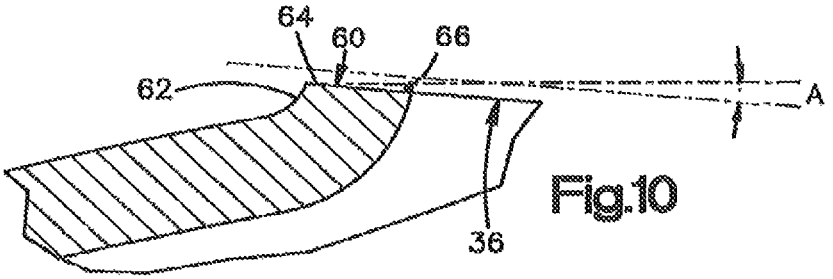
FIG. 10 is an enlarged cross sectional view of a portion of the aperture in the can bottom.

Wall 62 terminates at a rim 64, which defines a rim surface 64 at its terminal face. In circumstances in which upstanding wall 62 approaches vertical at rim 64, rim surface 64 will form an angle A that is approaches horizontal. The angle that rim surface 64 (in cross section) forms relative to a horizontal reference line, as shown best in FIG. 10, encompasses any angle (other than 90 degrees or nearly 90 degrees—that is, other than vertical). Preferably, angle A is between −30 degrees and 60 degrees, more preferably zero and 45 degrees, more preferably between 5 and 40 degrees. For measuring, a best fit line can be drawn through rim surface 64 and projected therefrom.

As wall 62 is upstanding and/or rim surface angle A is not 90 degrees, rim 64 has an inboard side and an outboard side, as defined radially relative to the a vertical centerline of aperture 36. Inboard side is radially inward relative aperture 36 and outboard side is radially outward relative to aperture 36. When aperture 36 is formed by opposing tooling, as is common for forming grommet apertures, a burr 66 is formed at least on one edge of the rim of the aperture.

A burr, in general, is a thin projection of metal that extends from an edge or rough edge. Burrs are formed as part of metal fabricating steps, such as forming the throughhole in a domed base. When used for aerosols, it may be preferable when forming an aperture for a grommet to set up the tooling and control it so that the burr is formed on outboard side of the rim such that the burr does not contact or dig into the polymer material of the grommet. The inventors have found, however, that when employing modern tooling with modern grommets, a burr can contact the grommet in a way that does not compromise the function of the grommet during and after charging. The burr when formed on the inboard side is thus not in contact with or has reduced contact with the liquid product (compared with a burr located on the outboard side of the aperture rim), which is beneficial because burrs of apertures usually lack sufficient lacquer coating as a barrier against liquid product contact.

The invention is not limited to any particular grommet. For purposes of illustration, a grommet marketed as the Ultramotive™ grommet is shown in the figures and described. A person familiar with grommet and propellant charging technology related to grommets will understand the use of other grommet configurations, such a universal grommet or other commercially available grommets.

Figure 8:
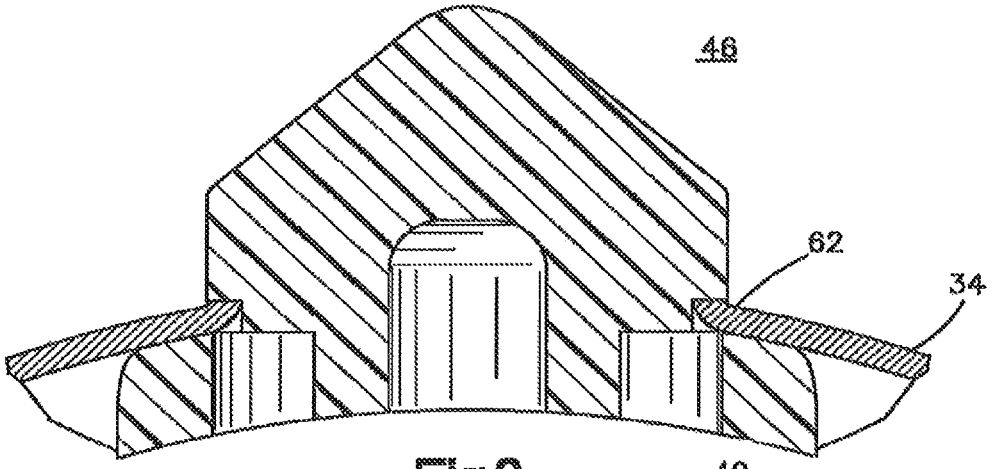
FIG. 8 is an enlarged cross sectional view a portion of the dome of the can of FIG. 1 bisecting the grommet.
Figure 9:
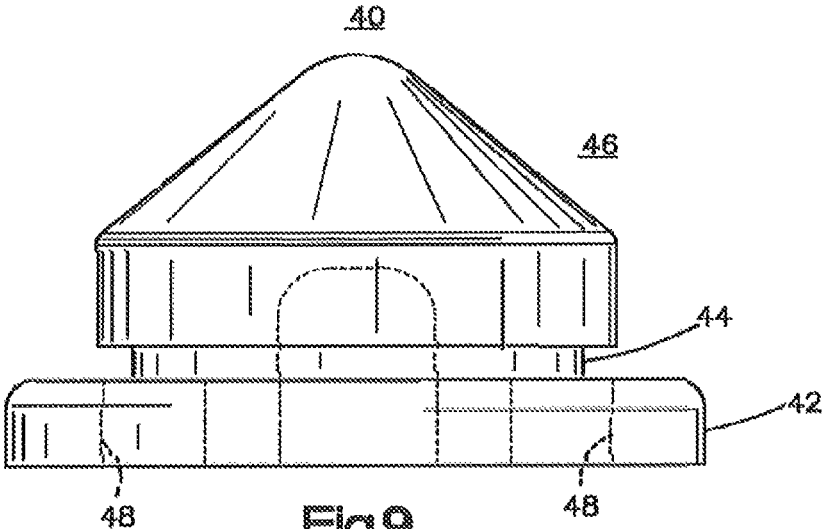
FIG. 9 is a cross sectional view bisecting the grommet before installation into the aperture.

Grommet 40 has a base 42, a neck 44, and a crown 46. Neck 16 fits within the aperture 36 as shown in the figures, as best illustrated in FIG. 8. FIG. 9 illustrates grommet 40 before insertion into aperture 36.

Base 42 has four through openings 48 through which propellant may be inserted to charge can 10. Openings 48 extend through base 42 to the extent that at least a portion of the openings 48 are in communication with the space about neck 44. During the charging process, a pin of a gassing head is applied to the center of grommet 40 to stretch neck 44 and extend crown 46 upwardly to lift crown 46 out of engagement with base 42. Thus, upon stretching, openings 48 communicate with the interior of can assembly 10 to charge the can with propellant. Then when the gassing head is removed, the elastic grommet returns to its at-rest positions shown in FIG. 8 in which openings 48 are sealed, which is referred to as the grommet's sealing state. Grommet 40 also has features that facilitate stretching the neck 16 during the charging process, as is understood by persons familiar with grommet structure and function. The portion of U.S. Pat. No. 6,729,362 explained the structure of the grommet in its relaxed state, sealing state, and charging state is incorporated herein by reference. The inventors have found that, contrary to the conventional thinking, even with a burr located on the inboard side of the rim 64 (that is, inwardly facing toward the grommet), the grommet can extend between its relaxed state and charging state and back again without interfering in the charging or sealing functions of the grommet.

To form can 10, can body 20 is first formed, preferably by conventional means. Aperture 36 is formed by the action of opposing tools contacting the opposing surfaces (inboard and outboard) of dome 34. The tooling deforms the dome surface about aperture 36 to thereby form upstanding wall 62 and rim surface 64. Preferably, there is no recess or countersink about upstanding wall 62 to receive or recess grommet base 42. Thus, dome 34 preferably has a smooth and unbroken curve that extends outwardly from upstanding wall 62. The grommet 40 is installed from the bottom of can body 20. After the can is filled with product and sealed by seaming an end onto the can body, the can is charged with a gas. The product may be any beverage. One example is a coffee product with milk or cream, and the charging gas is nitrous oxide.

The tooling for forming aperture 36, including aperture rim 60, upstanding wall 62, and rim surface 64 are well known, which will be understood by persons familiar with manufacturing of cans having grommets. Preferably, the grommet is installed from the underside of can 20, rather than through the open end of the can, for reasons of access and alignment. Moreover, persons familiar with grommet technology will understand tooling configurations that are capable of forming the burr on the inboard side of rim surface 64.

The present invention is described using embodiments that are not intended to be limiting. Rather, the claims are intended to define the scope of the invention.

What is claimed:

1. A method of forming a valve in a drawn and ironed beverage can body, the method comprising:

in a one-piece, drawn and ironed beverage can body that includes a dome in a base, a foot outboard of the base, and an elongate ironed sidewall extending upwardly from the foot, the dome having an aperture therethrough and a wall about the aperture that terminates in a rim, the rim having an inboard side and an outboard side, wherein the inboard side is radially inward relative to the outboard side with respect to the aperture, positioning a first tool in an interior of the can body, the first tool contacting an interior surface of the dome;

contacting an exterior surface of the dome with a second tool such that the first and second tools are aligned;

forming the aperture in the dome by the contacting steps of the first and second tools such that a burr is formed on the inboard side of the rim of the aperture; and inserting a grommet into the aperture, such that the burr is inwardly oriented relative to the grommet.

2. The method of claim 1 further comprising deforming a portion of the dome adjacent the aperture to form an upstanding wall.

3. The method of claim 2 wherein the deforming step occurs at the same time as the forming step and before the inserting step.

4. The method of claim 2 wherein the upstanding wall is vertical or nearly vertical.

5. The method of claim 2 wherein the upstanding wall is circumferential about the aperture.

6. The method of claim 2 wherein the dome is recess-less about the upstanding wall such that the base of the grommet is not recessed relative to the dome.

7. The method of claim 2 wherein the dome has a recess about the upstanding wall such that the base of the grommet is recessed relative to the dome.

8. The method of claim 2 wherein the upstanding wall terminates at a rim surface that forms an angle A relative to a horizontal reference line that is between −30 degrees and 60 degrees.

9. The method of claim 8 wherein angle A is between zero and 45 degrees.

10. The method of claim 8 wherein angle A is between 5 and 40 degrees.

11. The method of claim 1 wherein the burr contacts the grommet.

12. The method of claim 1 wherein the grommet, after the inserting step, includes a base located on the outboard side of the dome, a crown located on the inboard side of the dome, and a neck between the base and the dome for receiving the rim of the aperture.

13. The method of claim 1 wherein the burr contacts a neck of the grommet after the inserting step when the grommet is in its sealing state.

14. The method of claim 1 wherein the grommet is adapted for contacting a liquid product after seaming and filling steps.

* * * * *